US011090819B2

(12) United States Patent
Doeren

(10) Patent No.: US 11,090,819 B2
(45) Date of Patent: Aug. 17, 2021

(54) KNIFE

(75) Inventor: Wolfgang Doeren, Solingen (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 13/636,178

(22) PCT Filed: May 3, 2011

(86) PCT No.: PCT/DE2011/001021

§ 371 (c)(1),
(2), (4) Date: Oct. 10, 2012

(87) PCT Pub. No.: WO2011/150907

PCT Pub. Date: Dec. 8, 2011

(65) Prior Publication Data

US 2013/0205598 A1 Aug. 15, 2013

(30) Foreign Application Priority Data

May 5, 2010 (DE) ..... 102010019571.5

(51) Int. Cl.
*B26B 5/00* (2006.01)

(52) U.S. Cl.
CPC ..... *B26B 5/00* (2013.01); *B26B 5/001* (2013.01)

(58) Field of Classification Search
CPC ..... B26B 5/00; B26B 5/001; B26B 5/002; B26B 5/003; B26B 1/048; B26B 5/005; B26B 5/006; B26B 1/00; B26B 1/08
USPC ..... 30/161–163, 303
See application file for complete search history.

(56) References Cited

U.S. PATENT DOCUMENTS

| | | | | |
|---|---|---|---|---|
| 4,320,576 A | | 3/1982 | Beermann | |
| 5,203,085 A | * | 4/1993 | Berns | 30/163 |
| 5,337,481 A | * | 8/1994 | Mears | 30/162 |
| 5,386,632 A | * | 2/1995 | Schmidt | B26B 5/001 30/125 |
| 5,581,890 A | * | 12/1996 | Schmidt | B26B 5/003 30/162 |
| 5,604,984 A | * | 2/1997 | Shepherd | B26B 5/001 30/125 |
| 5,617,635 A | * | 4/1997 | Berns | B26B 1/08 30/162 |

(Continued)

FOREIGN PATENT DOCUMENTS

| | | |
|---|---|---|
| CN | 2250848 Y | 4/1997 |
| CN | 2517553 Y | 10/2002 |

(Continued)

*Primary Examiner* — Andrea L Wellington
*Assistant Examiner* — Richard D Crosby, Jr.
(74) *Attorney, Agent, or Firm* — Andrew Wilford

(57) ABSTRACT

The invention relates, inter alia, to a knife with a housing comprising a first housing part (12) and a second housing part (13) and also a blade carrier (20), in which a blade (15) is retained, wherein the first housing part (12), in particular for a blade changeover, can be released from the second housing part (13) and fastened thereon again, wherein the blade carrier (20) is mounted in the housing (11) such that it can be moved between a basic position and a cutting position. The special feature is that the blade carrier (20) is connected to the second housing part (13) in a non-releasable manner, and that the blade carrier (20) and the second housing part (13) form a preassemblable structural unit which can be fastened on the first housing part (12) in a releasable manner.

10 Claims, 12 Drawing Sheets

(56) References Cited

U.S. PATENT DOCUMENTS

| | | | | |
|---|---|---|---|---|
| 5,813,121 | A | 9/1998 | Gringer | |
| 6,233,830 | B1 * | 5/2001 | Lamond et al. | 30/123 |
| 6,263,577 | B1 * | 7/2001 | Wonderley | B26B 5/003 30/152 |
| 6,560,873 | B1 * | 5/2003 | Ortner | B26B 29/02 30/2 |
| 6,832,438 | B1 * | 12/2004 | Gringeret al. | 30/162 |
| 7,316,070 | B2 | 1/2008 | Green | |
| 7,325,313 | B2 | 2/2008 | Gringer | |
| 7,434,317 | B2 | 10/2008 | Levine et al. | |
| 7,533,467 | B2 * | 5/2009 | Fossella | B26B 5/001 30/162 |
| 7,784,189 | B2 | 8/2010 | Polei | |
| 7,797,837 | B2 | 9/2010 | Wu | |
| 7,886,445 | B2 * | 2/2011 | Constantine | B26B 5/001 30/125 |
| 8,069,571 | B2 * | 12/2011 | Chung | B26B 5/00 30/162 |
| 8,307,556 | B2 * | 11/2012 | Davis | B26B 5/003 30/162 |
| 8,375,588 | B2 * | 2/2013 | Gringer | B26B 5/001 30/154 |
| 8,567,070 | B2 * | 10/2013 | Rowlay | B26B 5/002 30/162 |
| 8,689,450 | B2 * | 4/2014 | Constantine | B26B 1/08 30/162 |
| 9,457,483 | B2 * | 10/2016 | Wu | B26B 5/002 |
| 9,676,106 | B2 * | 6/2017 | Garavaglia | B26B 5/00 |
| 9,919,436 | B2 * | 3/2018 | Johnson | B26B 11/008 |
| 2005/0050734 | A1 * | 3/2005 | Kesinger | 30/162 |
| 2005/0172496 | A1 | 8/2005 | Zeng | |
| 2006/0059693 | A1 * | 3/2006 | Fossella | 30/125 |
| 2006/0130340 | A1 | 6/2006 | Berns | |
| 2007/0050988 | A1 * | 3/2007 | Di Bitonto et al. | 30/162 |
| 2008/0256808 | A1 * | 10/2008 | Levine et al. | 30/162 |
| 2009/0094840 | A1 * | 4/2009 | Kanemoto et al. | 30/162 |
| 2009/0178283 | A1 * | 7/2009 | Wu | 30/162 |
| 2009/0235533 | A1 * | 9/2009 | Huang | 30/143 |
| 2010/0180449 | A1 * | 7/2010 | van Deursen | 30/162 |
| 2012/0073142 | A1 * | 3/2012 | Zeng | 30/162 |
| 2012/0124843 | A1 * | 5/2012 | Reibold | B26B 29/02 30/289 |
| 2012/0174412 | A1 * | 7/2012 | Ho | 30/152 |
| 2014/0041235 | A1 * | 2/2014 | Hsu | 30/162 |
| 2014/0053410 | A1 * | 2/2014 | Huang | 30/162 |
| 2016/0167239 | A1 * | 6/2016 | Gallegos | B26B 5/001 30/162 |

FOREIGN PATENT DOCUMENTS

| | | | |
|---|---|---|---|
| CN | 2691306 | Y | 4/2005 |
| DE | 19601015 | A | 7/1997 |
| GB | 1547002 | A | 6/1979 |

* cited by examiner

KNIFE

CROSS REFERENCE TO RELATED APPLICATIONS

This application is the US-national stage of PCT application PCT/DE2011/001021 filed 3 May 2011, published 8 Dec. 2011 as WO2011/150907, and claiming the priority of German patent application 102010019571.5 itself filed 5 May 2010.

FIELD OF THE INVENTION

The invention relates to a knife with a housing having a first part and a second part, as well as a blade support adapted to hold a blade, the first part in particular for blade replacement being releaseable from and attached again to the second part, the blade support being moveably supported in the housing between a base position and a cutting position.

BACKGROUND OF THE INVENTION

A knife of this type is known from prior public use. The knife has a first part. A second part can be pushed into a seat of the first part through an opening on the rear housing end. As soon as the second part has reached its seat in the first part, it catches and cannot be released from the first part again until a retaining force of the catch device has been overcome.

If the second part is in the seat of the first part and the blade support is in its rear position, the blade is inaccessible by the user, injury therefore cannot occur. A blade change is not possible until the second part has been separated from the first part. The blade can then be removed and replaced by a new blade.

OBJECT OF THE INVENTION

The object of the invention is to create a knife that renders possible easy handling and moreover is simple to manufacture. Furthermore, it is the object of the invention to combine different knife models, for example, right-handed and left-handed knives, in one knife.

SUMMARY OF THE INVENTION

The object is attained according to a first aspect of the invention by a knife in which the blade support is fixed on the second part. In particular the blade support is supported on the second part such that it can be moved between a rear position and a front position. The blade support forms with the second part a subassembly that can be preassembled separately. Furthermore, this subassembly can be attached as a subassembly to the second part and released therefrom.

The assembly and disassembly of the first and the second part are considerably facilitated with the knife according to the invention. Moreover, the risk of injury during assembly and disassembly of the first and the second part is reduced, in particular because the blade support is firmly connected to the second part and cannot be accidentally released therefrom.

The principle of the invention lies in that the first part has longitudinal slots on two side faces lying opposite one another open toward a rear knife end, thereby forming two free housing legs. Each housing leg has a bearing and guide structure that can be brought releasably into engagement positively with a bearing and guide structure of the second part. If the bearing and guide structures of the first and of the second part are positively engaged, relative movement in the form of spreading or shear movement between the free end regions of the first part as well as relative movement between each free end region of the first and the second part is ruled out. According to the invention it is possible that the second part together with the blade support and the two handles for actuating the blade support is preassembled as a subassembly and attached to the first part.

The advantage is that right-handed and left-handed knives no longer have to be produced separately. The knife according to the invention can be a right-handed knife and left-handed knife and nevertheless the second part together with the handles for actuating the blade support can be mounted as a subassembly on the first part.

According to a first embodiment, a handle is attached on each side of the blade support to actuate the blade support. For example, one handle can be attached to a rear part of the blade support and a second handle can be attached to a latch that is moveable relative to the rear part. The handle can be connected for example permanently to the blade support. According to an advantageous embodiment, for example the handle is formed on the blade support. In particular one handle is provided on a rear part and one further handle is provided on the latch.

A further embodiment of the invention is characterized in that the blade support is firmly connected to the second part. The blade support can be for example connected to the second part such that it cannot be separated or can be separated only by means of a tool from the second part. The blade support can be mounted on the second part can be such that the blade support can be moved between a rear position and a front position, but cannot be separated from the second part. A spring element can urge the blade support for example relative to the second part into the rear position.

A further embodiment is characterized in that the first part has primary bearing and guide structures that fit positively with secondary bearing and guide structures of the second part. The primary bearing and guide structures can be provided for example on the free housing ends of the first part. The bearing and guide structures can be formed such that they guide the second part relative to the first part in a bearing seat, in which the first part and the second part can be locked with a locking device. Positive closure between the first and the second part is effected for example such that a spreading or shear movement of the free end regions with respect to one another or relative to the second part cannot occur.

According to a further embodiment, one of the parts is provided with grooves that fit with complementary rails of the other part. The grooves and rails can extend for example parallel to a longitudinal center axis of the knife.

A further embodiment is characterized in that the groove is of T-section. The T-shape can extend for example parallel to the longitudinal center axis of the knife. T-shaped within the meaning of the invention means that the structure has a first rail-like plane and a second rail-like plane, the second plane extending at an angle, for example a right angle, to the first plane. The second plane can be defined for example by projections.

A further embodiment of the invention is characterized in that a locking device is provided that has first locking means assigned to the first part and second locking means assigned to the second part so that the locking device can be moved between a locking position and a release position by an actuating mechanism, for example a key button. For resetting for example, the locking device can be urged into the locking position.

Another embodiment of the invention is characterized in that the locking device has locking means that can lock the blade support to the second part when the locking device is moved into the release position. The locking means for locking the blade support to the second part can be formed by the first locking means, the second locking means or by additional third locking means. The advantage lies among other things in that with disassembly of the second part the risk of injury by an accidental extension of the blade support into the front position is prevented. Moreover, an overexpansion of the spring element is prevented, which urges the blade support into the base position.

BRIEF DESCRIPTION OF THE DRAWING

Further advantages are shown based on an illustrated embodiment shown in the drawings. Therein.

SPECIFIC DESCRIPTION OF THE INVENTION

A knife is identified in the figures by reference 10. The same reference numbers in the different figures designate corresponding parts, with the addition or omission of lowercase letters.

Figure 1:
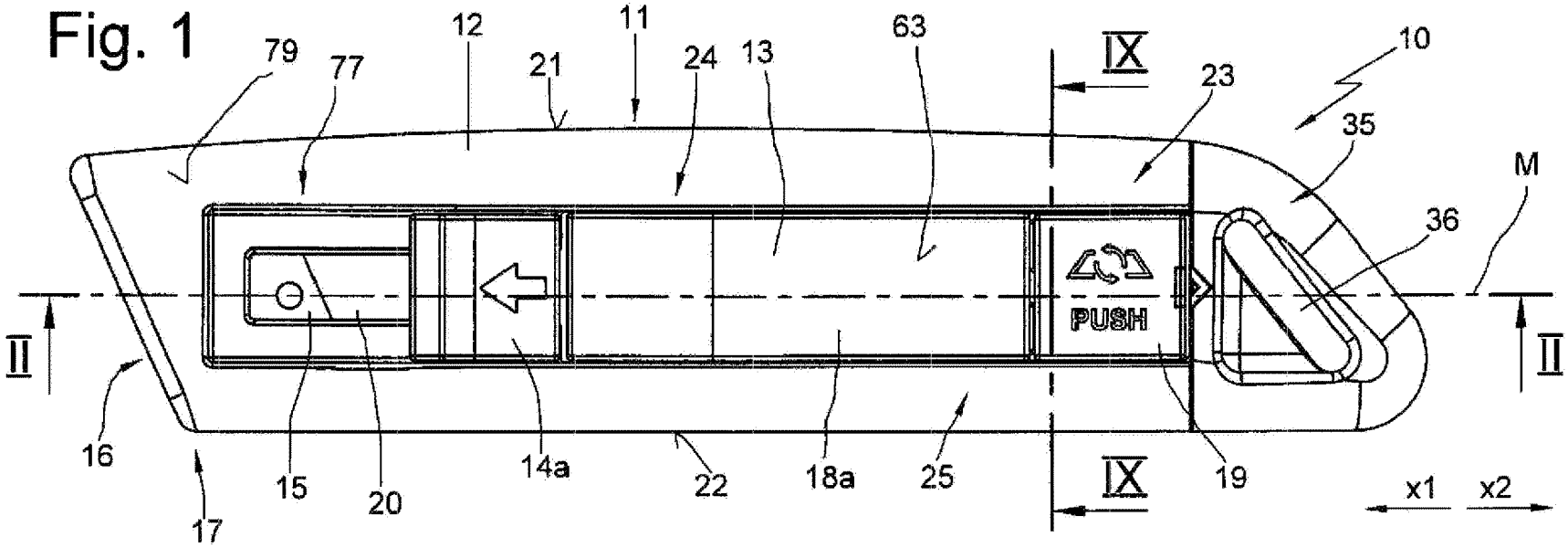
FIG. 1 is a side view of the knife with the blade in a rear position.
Figure 2:
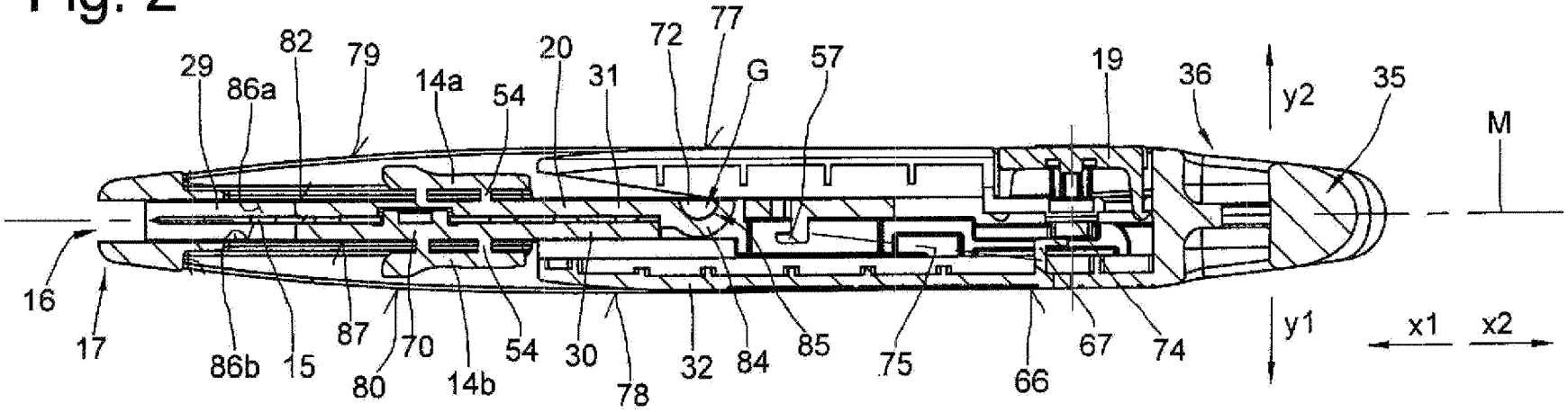
FIG. 2 is a section through the knife along line II-II of FIG. 1.
Figure 3:
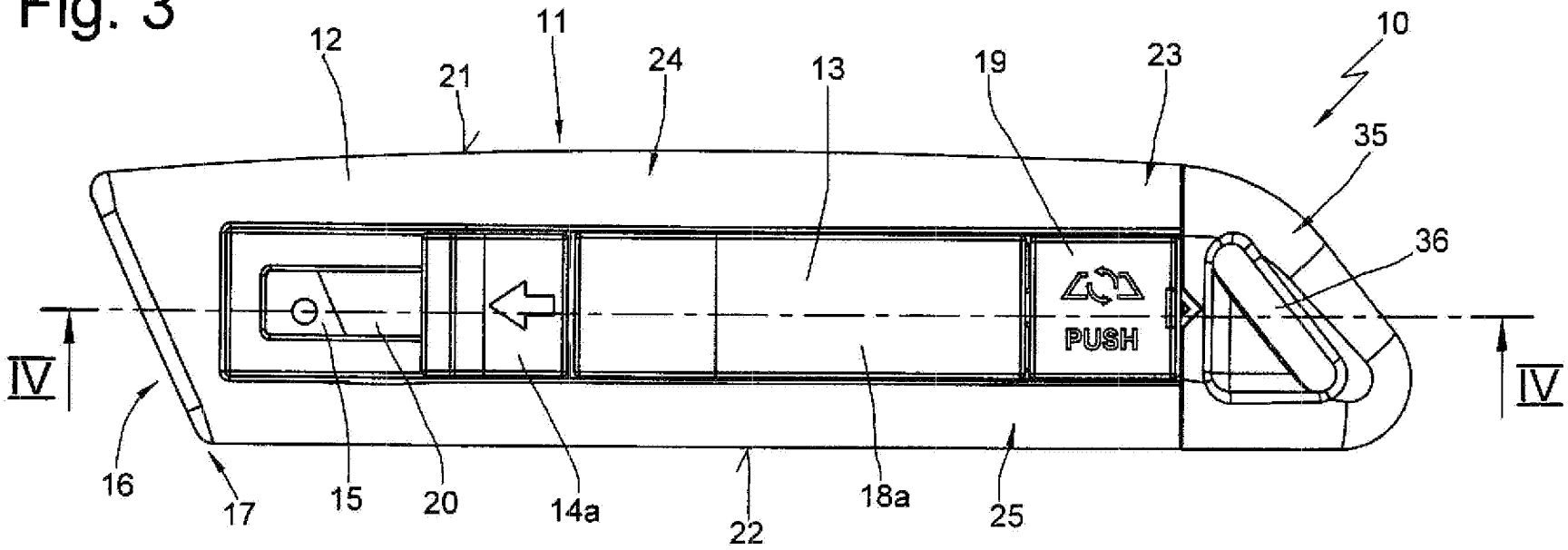
FIG. 3 is a side view like FIG. 1, with an actuating element in the actuated position.
Figure 4:
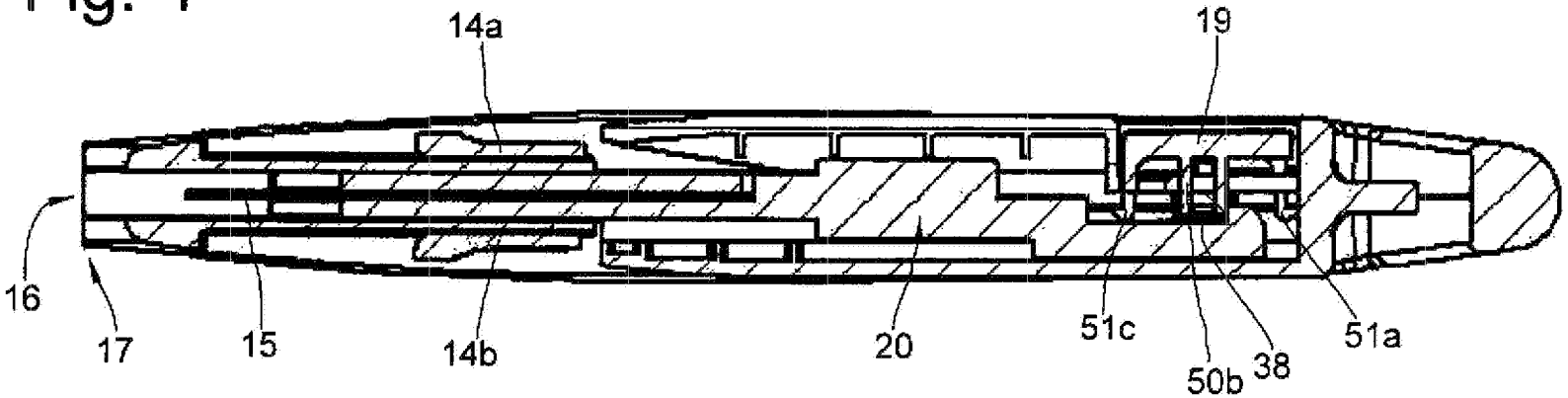
FIG. 4 is a section through the knife along line IV-IV of FIG. 3.

According to FIGS. 1 and 2, the knife 10 has a housing 11 with a first part 12 and a second part 13. The housing 11 has an upper face 21, a lower face 22, as well as housing side faces 77 and 78. The housing side face 77 is essentially formed by a side face 79 of the first part 12 and by an outer surface 63 of a cover 33 (see FIG. 8) of the second part 13. The housing side face 78 is essentially formed by a side face 80 of the first part 12 and by an outer surface 66 of a rear part 32.

Figure 5:
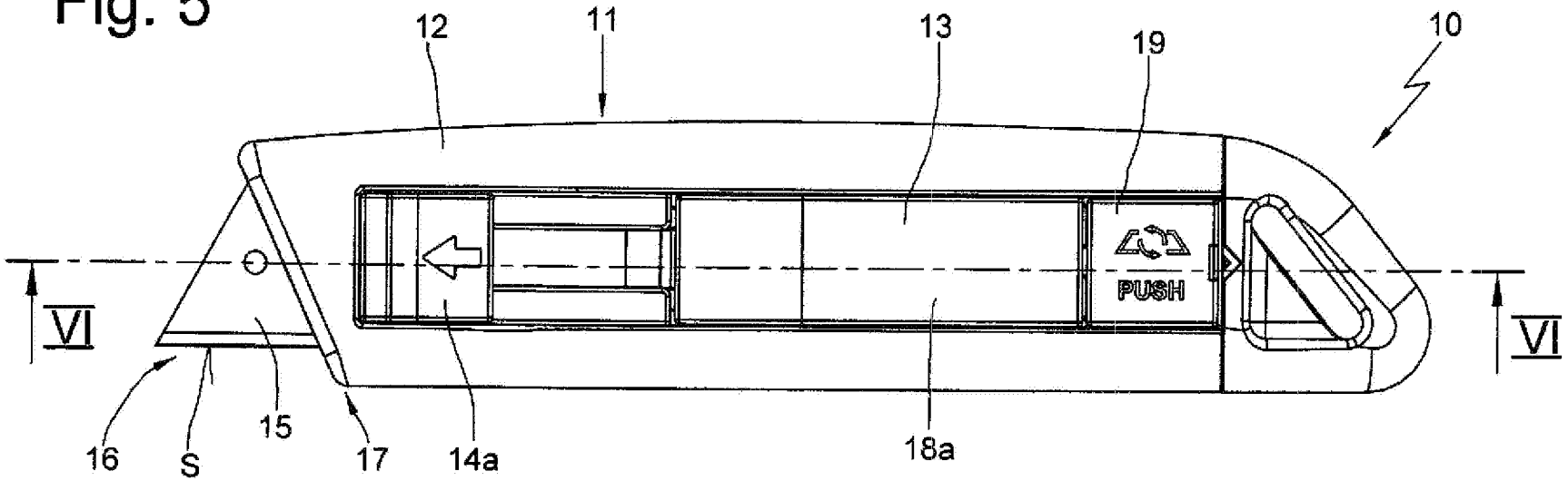
FIG. 5 is a side view like FIG. 1 of the knife in the front position.
Figure 6:
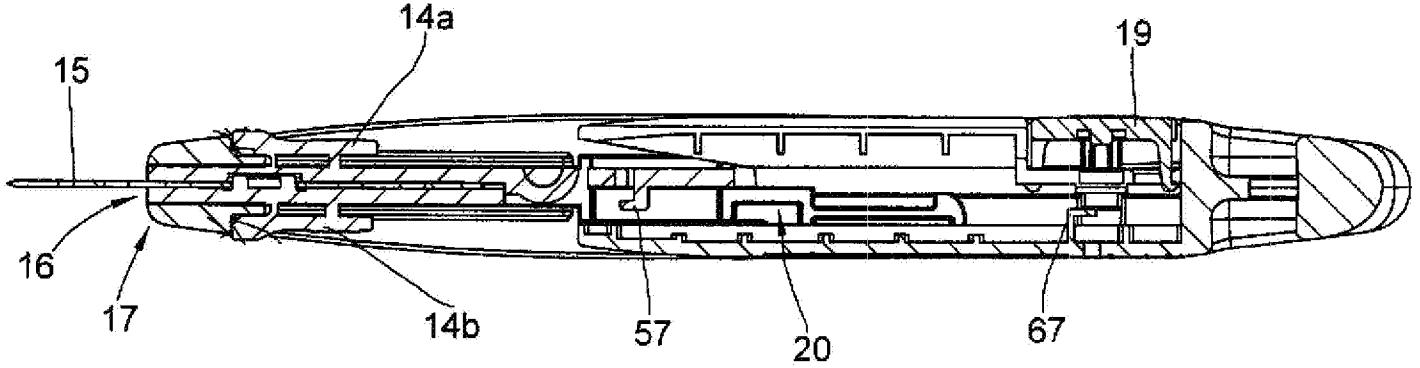
FIG. 6 is a section along line VI-VI of FIG. 5.

Furthermore, the knife 10 has a blade support 20 with a blade 15. The blade support 20 is moveably supported in a channel 29 of the housing 11 and by actuation of one of the handles 14*a* or 14*b* can be moved from for example from a rear position shown in FIGS. 1 and 2 into a front position shown in FIGS. 5 and 6. In the front position, the blade 15 projects from an opening 16 on a front end 17 of the first part 12. In the rear position, the blade 15 is completely retracted into the housing 11 so that a user cannot be injured by the blade 15.

The blade 15 is urged into the rear position by a spring element 75 merely indicated by a dashed line. Movement from the rear position into the front position is a straight-line movement of the blade support 20 parallel to a center axis M of the knife in direction x1. Movement from the front position into the rear position is in the reverse direction x2 likewise by a straight-line movement parallel to the center axis M.

A portion 35 of the second part 13 borders a rear end region 23 of the first part 12 and forms the rear end of the housing 11. A longitudinal slot 36 is formed in the portion 35. The longitudinal slot 36 can serve for example to attach a loop or to suspend the knife 10.

The blade 15 is held firmly in the blade support 20 between a rear part 30 and a latch 31 and in the assembled state of the knife 10 according to FIGS. 1 through 6 cannot be removed from the blade support 20. An inner wall 86*a* of the first part 12 is in contact with an outer surface 82 of the latch 31 and an inner wall 86*b* of the first part 12 is in contact with an outer surface 87, so that the latch 31 is held in a blade holding position.

To remove the blade 15, for example in order to carry out a blade replacement, the release of the first and second parts 12 and 13 from one another is necessary. Only when the second part 13 has been released from the first part 12, can the blade 15 be removed from the blade support 20.

The first part 12 and the second part 13 are attached to one another by means of a locking device. The attachment can be released by an actuating element or key button 19 of the locking device. The locking device can be moved from the locked position shown in FIGS. 1 and 2 into the unlocked position in that the actuating element 19 according to FIG. 2 is moved against the restoring force of a spring element 74, merely indicated, in the direction y1 into the position shown in FIG. 4. In the unlocked position, the first part 12 and the second part 13 can be released from one another. In the locked position, the first part 12 and the second part 13 are firmly connected to one another.

Figure 7:
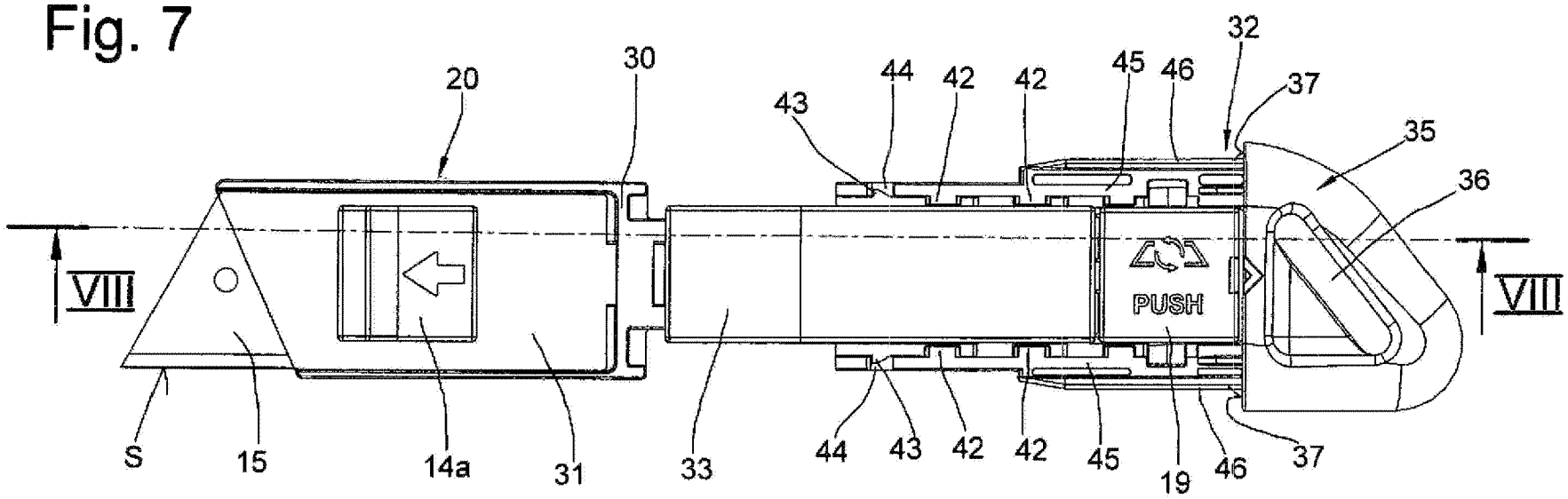
FIG. 7 is a side view of a second part of the knife housing and of the blade support.
Figure 8:
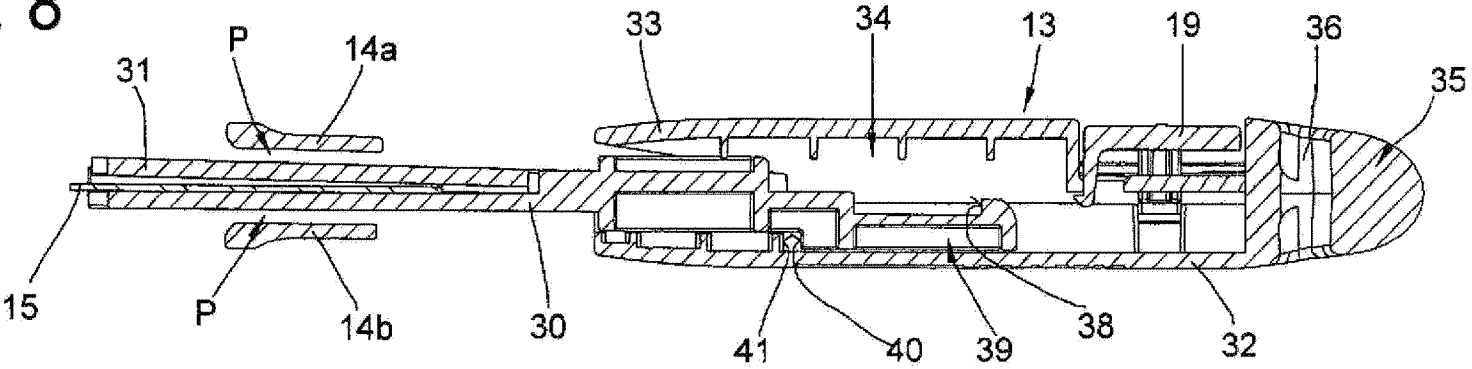
FIG. 8 is a section taken along line VIII-VIII of FIG. 7.

In FIGS. 7 and 8 a subassembly of the second part 13 and the blade support 20 is shown.

Figure 21:
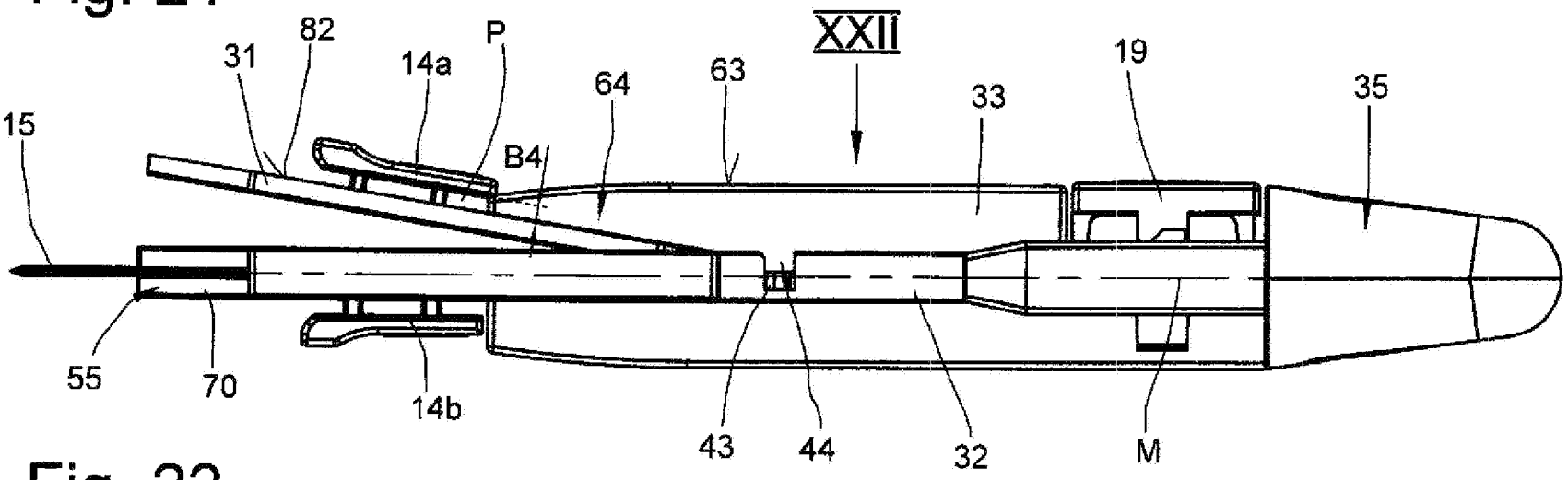
FIG. 21 is a bottom view of the subassembly of the second part and blade support with a latch of the blade support in an opened position, FIG. 22 a side view according to arrow XXII of FIG. 21.
Figure 22:
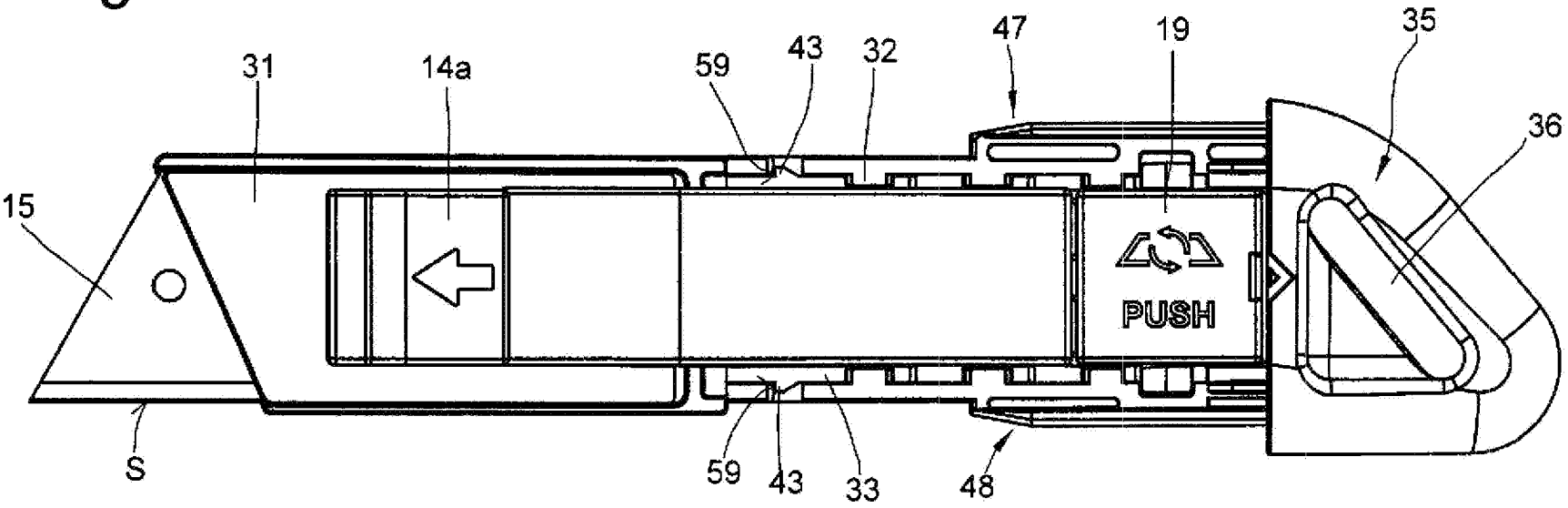
Figure 23:
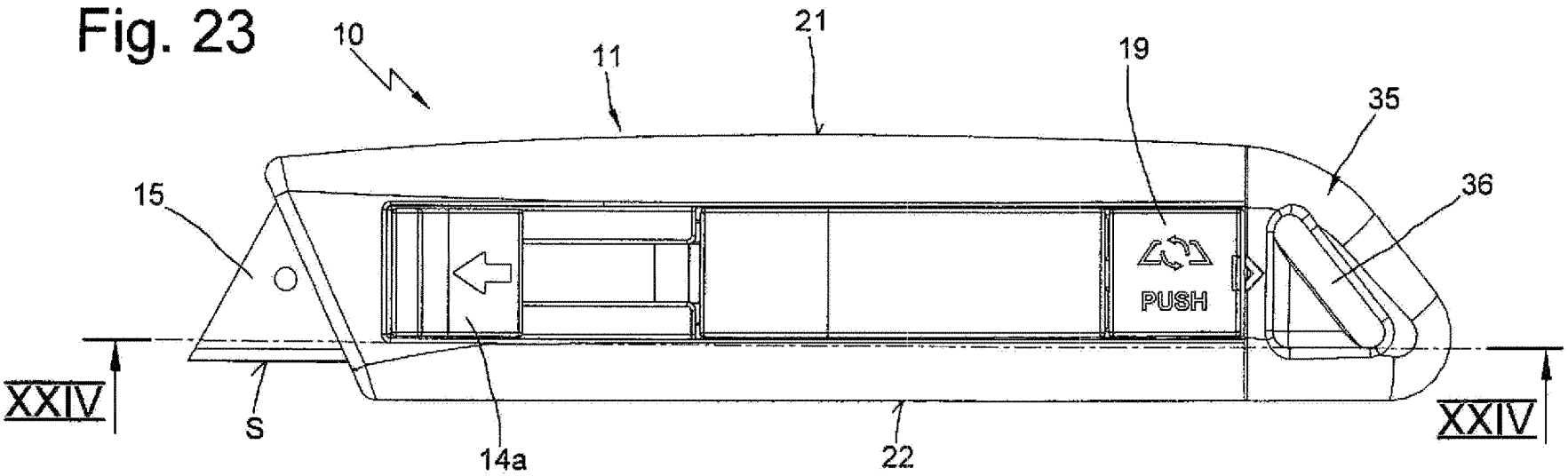
FIG. 23 is a side view of the knife in the cutting position according to FIG. 5.

When the subassembly of blade support 20 and the second part 13 has been released from the first part 12, according to FIG. 21 the latch 31 can be pivoted relative to the rear part 30 in the direction u1 from the blade holding position into a removal position in which the blade 15 can be removed from a blade seat 55.

In the removal position, a front end region 64 of the cover 33 of the second part 13 can be inserted into the gap S between the handle 14*a* and the outer surface 82 of the latch 31 so that the latch 31 remains in the opened position. A mounting surface 83 extends at an angle α to the longitudinal center axis M. In this manner movement of the latch 31 into the removal position is possible and, until the removal position is reached, the cover 33 is not located in the travel path of the latch 31. After a blade 15 has been placed into the blade seat 55, the latch 31 can be pivoted in the direction u2 into the blade-holding position.

Figure 10:
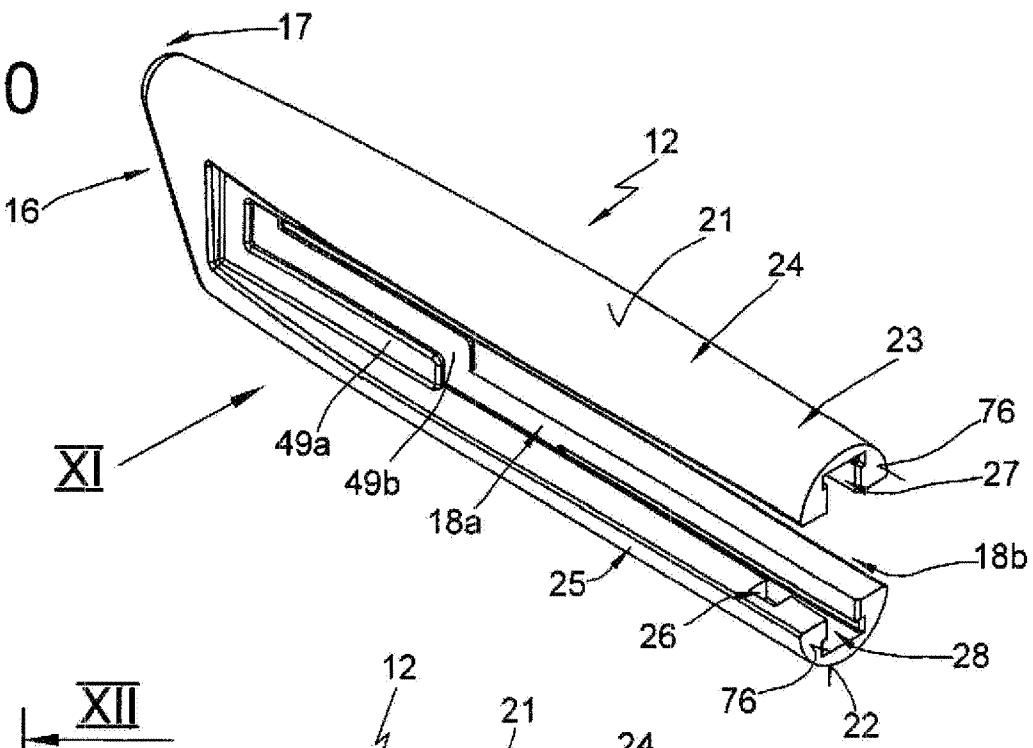
FIG. 10 is a perspective view of the first part of the knife housing.
Figure 11:
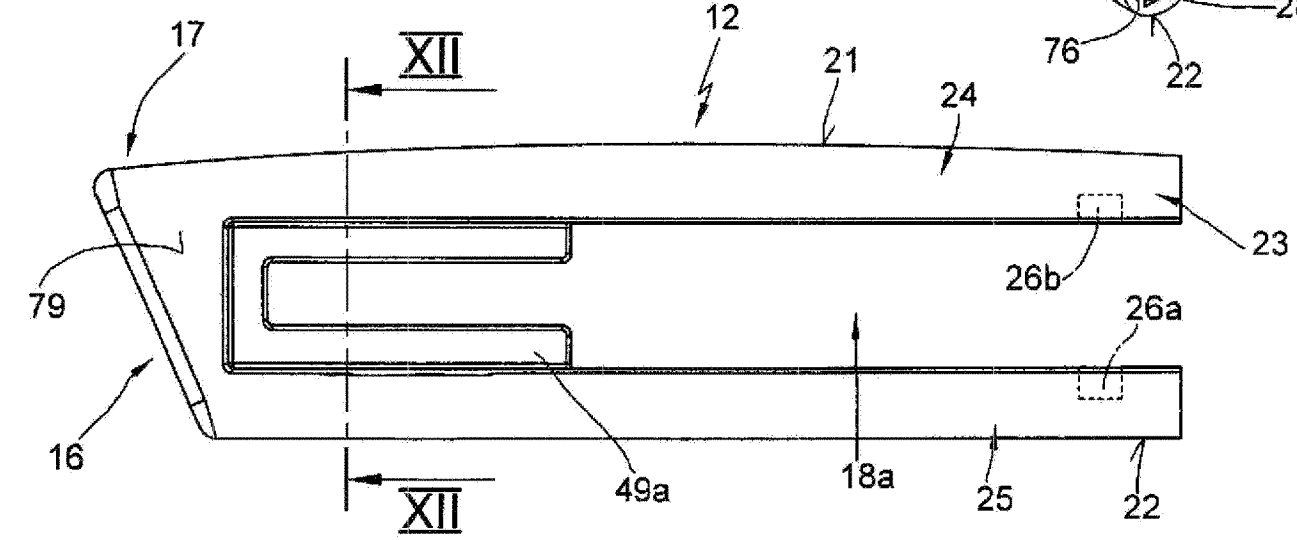
FIG. 11 is a side view of the first part.
Figure 12:
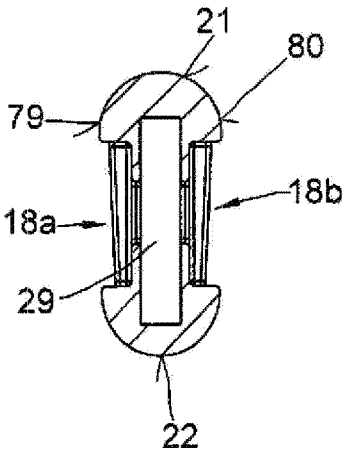
FIG. 12 is a section taken along line XII-XII of FIG. 11.
Figure 13:
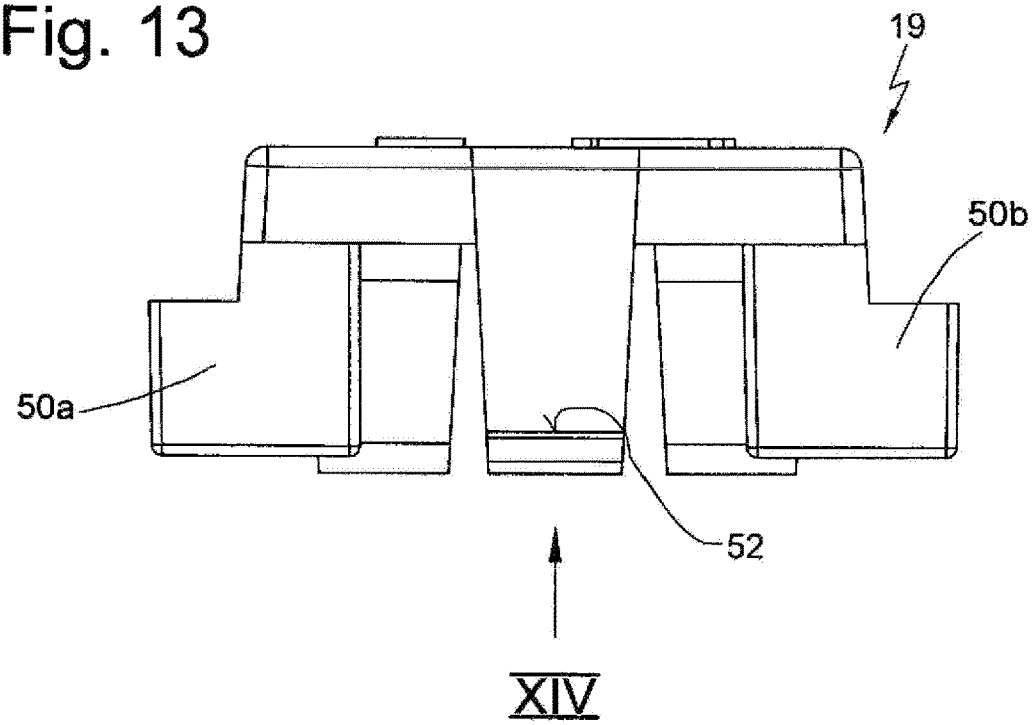
FIG. 13 is a side view of an actuating part.
Figure 14:
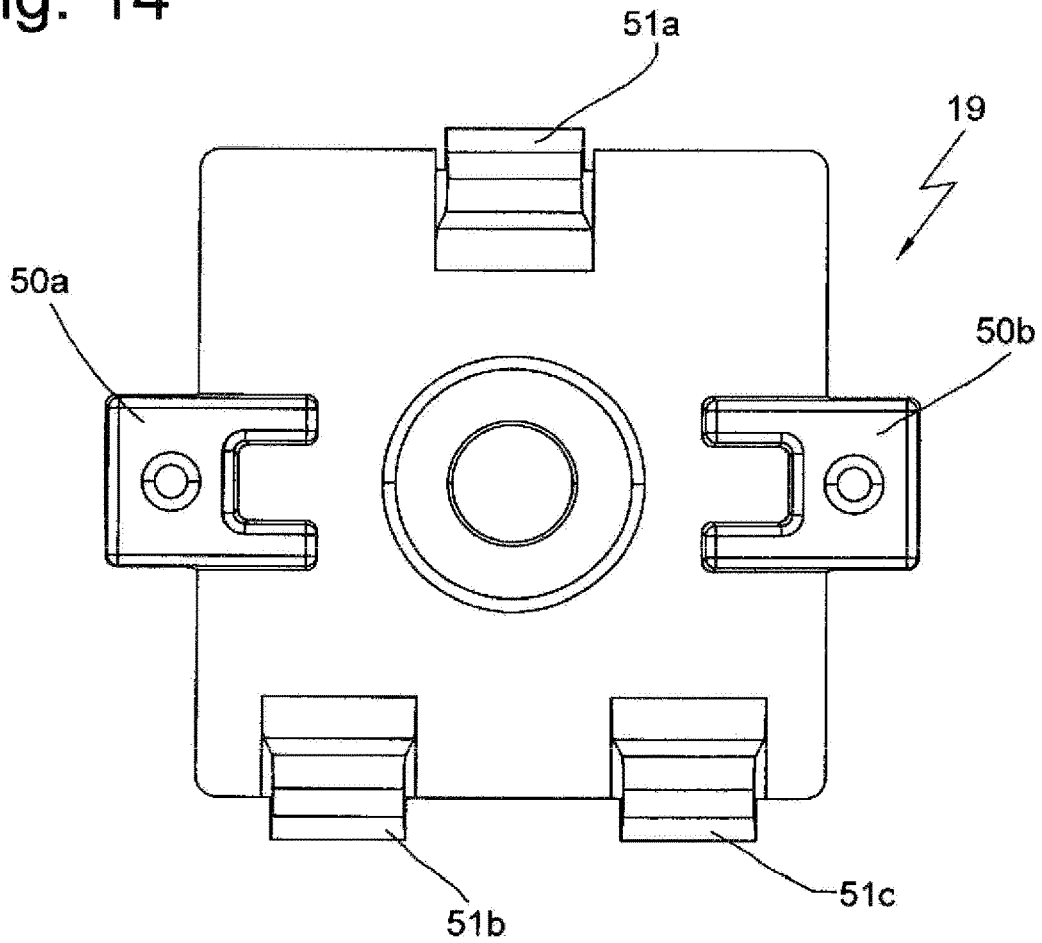
FIG. 14 is a bottom view of the actuating element according to arrow XIV of FIG. 13.

The first part 12 is shown in FIGS. 10 through 12. The opening 16 is formed on the front end 17 on the first part 12. Between the upper face 21 and the lower face 22, the housing side face 79 has a longitudinal slot 18*a* and the housing side face 80 has a confronting longitudinal slot 18*b*. In a forward region the longitudinal slots 18*a* and 18*b* are each narrowed by a plate 49*a* and 49*b*. The plates 49*a* and 49*b* prevent the penetration of dirt into the housing 11 and represent a visual protection that prevents the view of the interior of the housing.

The longitudinal slots 18*a* and 18*b* are open toward the rear end region. Free ends 24 and 25 of the first part 12 formed by the longitudinal slots 18*a* and 18*b* are provided with grooves 27 and 28 extending parallel to the longitudinal center axis M of the first part 12. One groove 27 is formed in the free end 24 and one groove 28 is formed in the free end 25. The grooves 27 and 28 are used to attach the second part 13 to the first part 12. A cut-out 26*a* is formed adjacent to the groove 28. A corresponding cut-out 26*b* is formed on the free end 24 and is shown in FIG. 11 by a dashed line. The cut-outs 26*a* and 26*b* are part of the locking device and fit with the actuating element 19, as explained in greater detail below. An end face 76 is fitted during installation of the first part 12 against a stop shoulder 37, not shown in FIGS. 10 through 12, of the second part 13.

Figure 9:
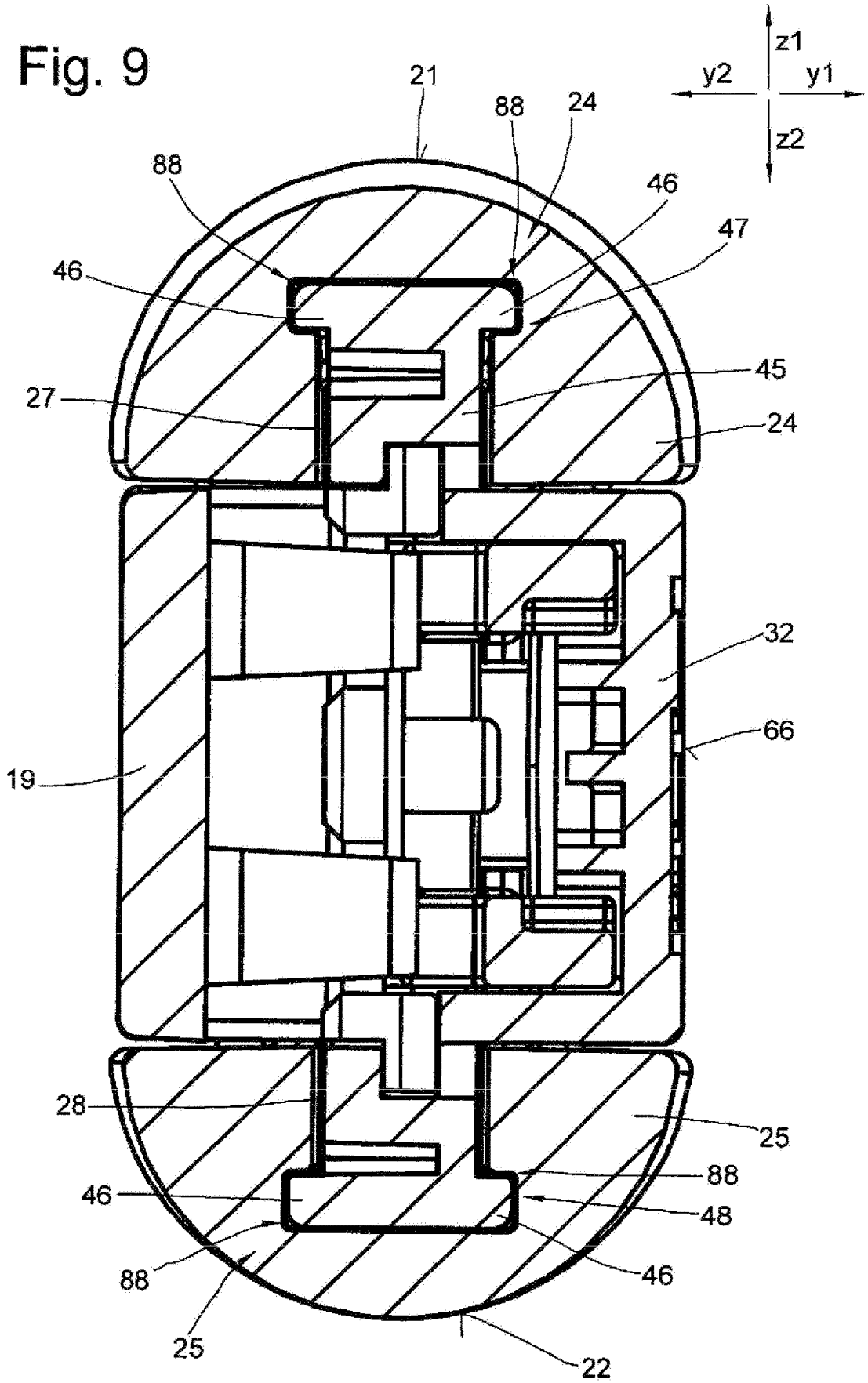
FIG. 9 is a section taken along line IX-IX of FIG. 1.
Figure 20:
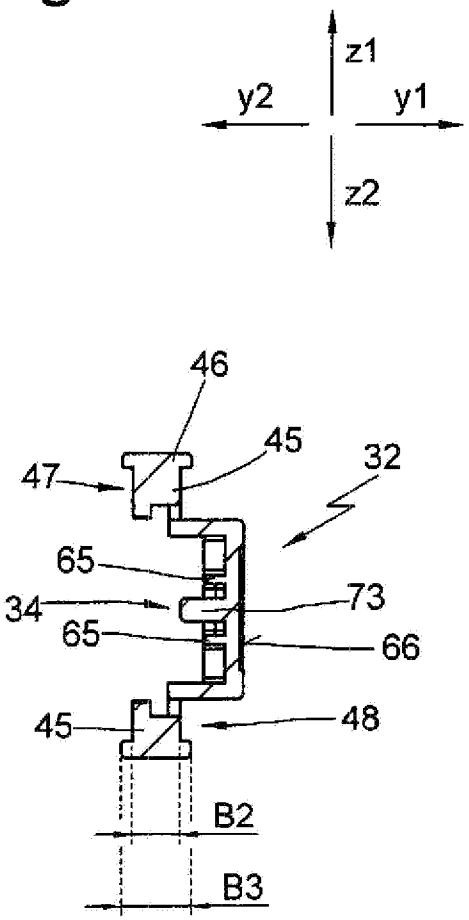
FIG. 20 is a section taken along line XX-XX of FIG. 19.

The second part 13 has the rear part 32 and the cover 33 (see, for example FIG. 9). For attaching and guiding on the first part 12, the rear part 32 has a guide structure 47 and a guide structure 48. Each guide structure 47 and 48 is approximately of T-section and has a region 45 lying in a plane extending parallel to the x-z plane, and lateral projections 46 extending parallel to the x-y plane and serving for engaging in undercuts 88 of the grooves 27 or 28 (see for example FIG. 9). While the region 45 extends in the y direction with a width B2, each guide structure 47, 48 in the region of the projections 46 has a width B3 (B2 and B3 are shown only in FIG. 20). Due to the positive engagement of the guide structures 47 and 48 in the grooves 27 and 28, neither relative movement between the free ends 24 and 25 nor relative movement between the second part 13 and one of the free ends 27 and 28 in the direction z1, z2 (spreading direction) and in the direction y1, y2 (shearing direction) is possible.

Figure 17:
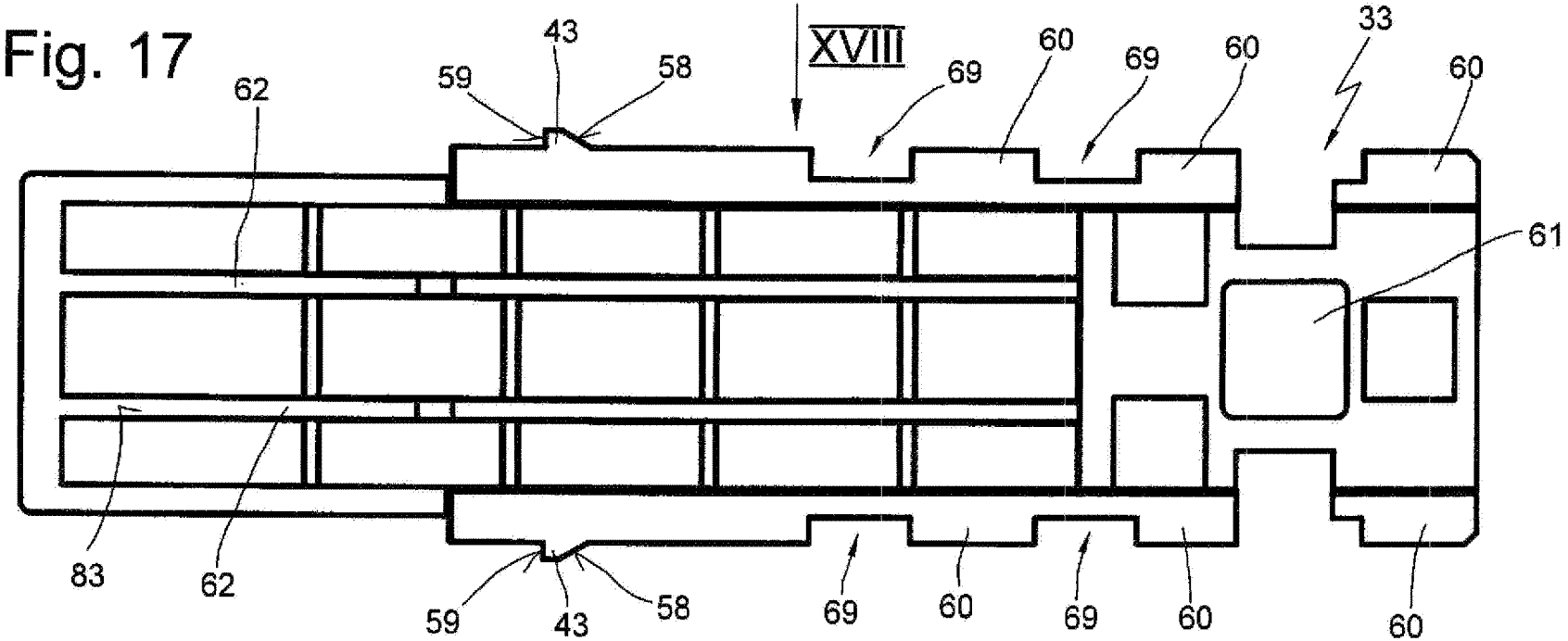
FIG. 17 is a side view of a cover of the second part.
Figure 18:
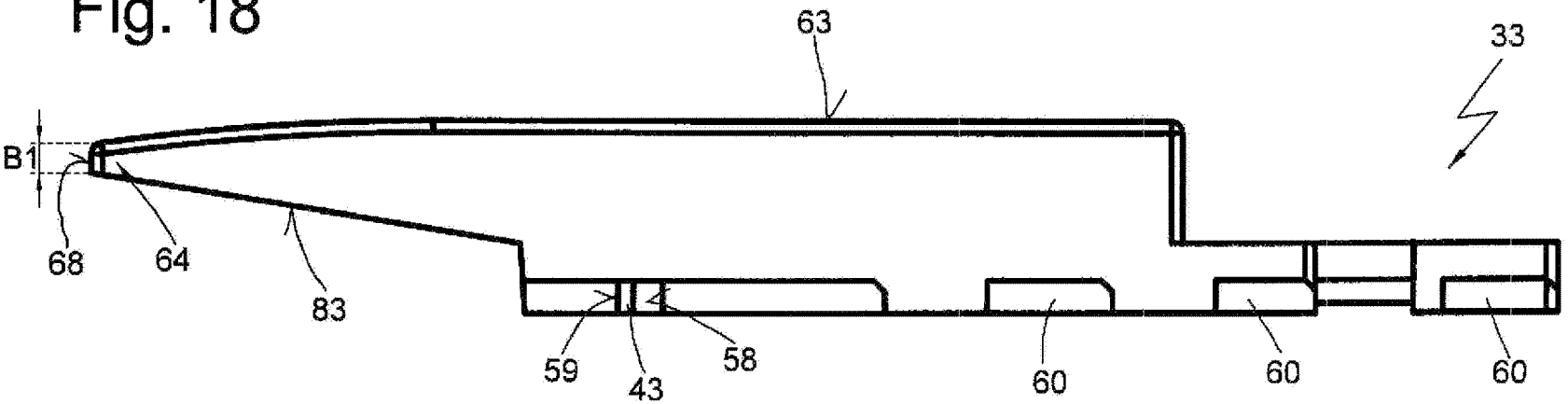
FIG. 18 is a top view of the cover according to arrow XVIII of FIG. 17.

The cover 33, which is part of the second part 13, is shown in FIGS. 17 and 18. It has guide ribs 62 for the sliding guidance of the blade support 20 as well as several tongues 60 that fit with the lugs 42 of the rear part 32 for attachment to the rear part 32. A cut-out 61 is provided for attachment of the actuating part 19. Furthermore, a catch projection 43 is formed on the cover 33 and is provided with an inclined surface 58 and a stop surface 59. The front end region 64 of the cover 33 tapers conically up to an end face 68. The end face 68 has a width B1. The width B1 is such with respect to a width B4 of the gap P such that the front end region 64 can engage in the gap P (the gap P is not discernible in FIG. 18).

Figure 19:
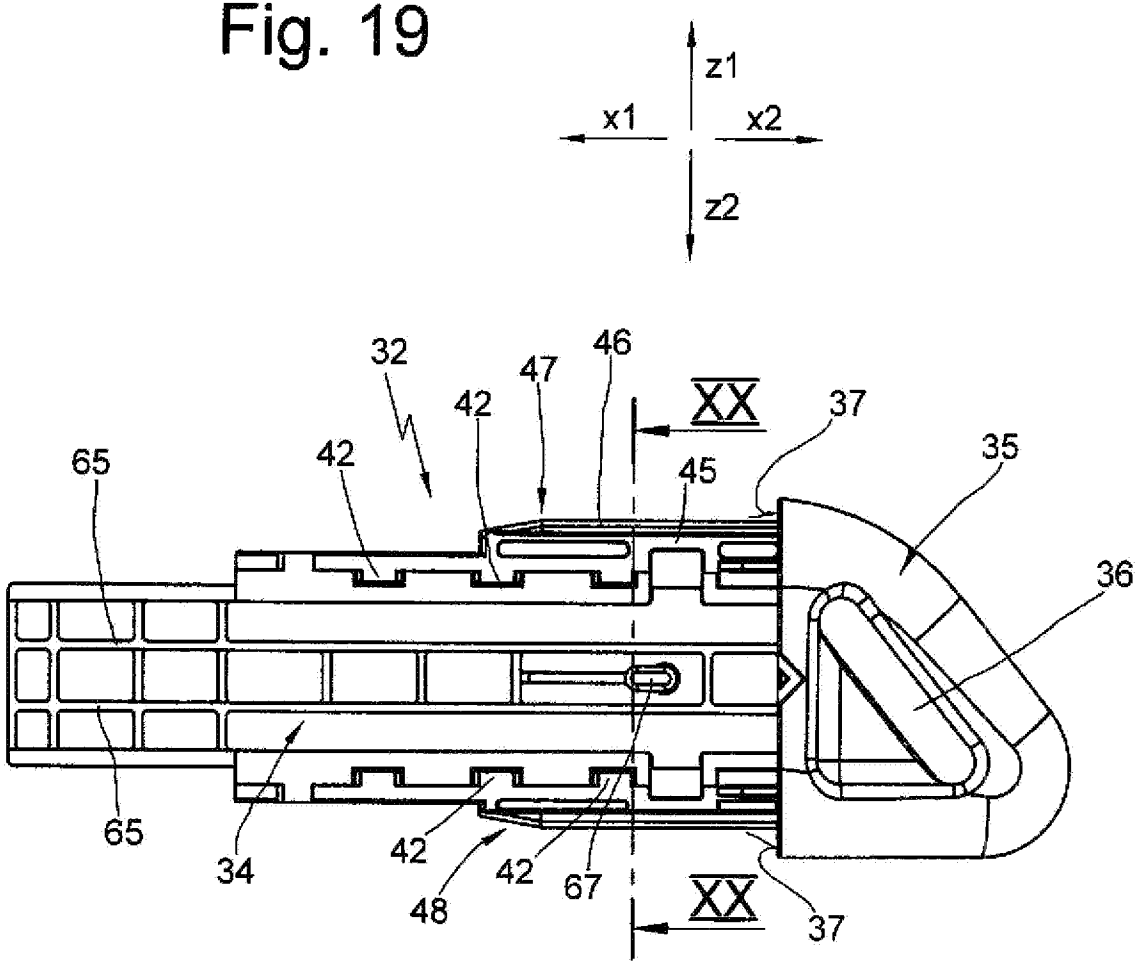
FIG. 19 is a side view of a rear part of the second part.

Lugs 42 formed on the rear part 32 (see, for example FIGS. 19 and 20) are used to attach the cover 33. An attaching element 67 serves to attach the spring element 75 that fits with the blade support 20. Guide ribs 65 are used for sliding guidance of the blade support 20 and to reduce friction. Furthermore, the guide ribs 65 reinforce the rear part while keeping the weight low.

Before mounting the cover 33 on the rear part 32, a rear extension 39 of the blade support 20 is fitted to a seat 34 formed by the rear part 32. To install the cover 33 on the rear part 32, the lugs 42 of the rear part 32 are overlapped with cut-outs 69 of the cover 33 adjacent the tongues 60. Subsequently, the cover 33 is displaced relative to the rear part 32 in the direction x2 until the catch projection 43 snaps into the catch cut-out 44 of the rear part 32.

Figure 24:
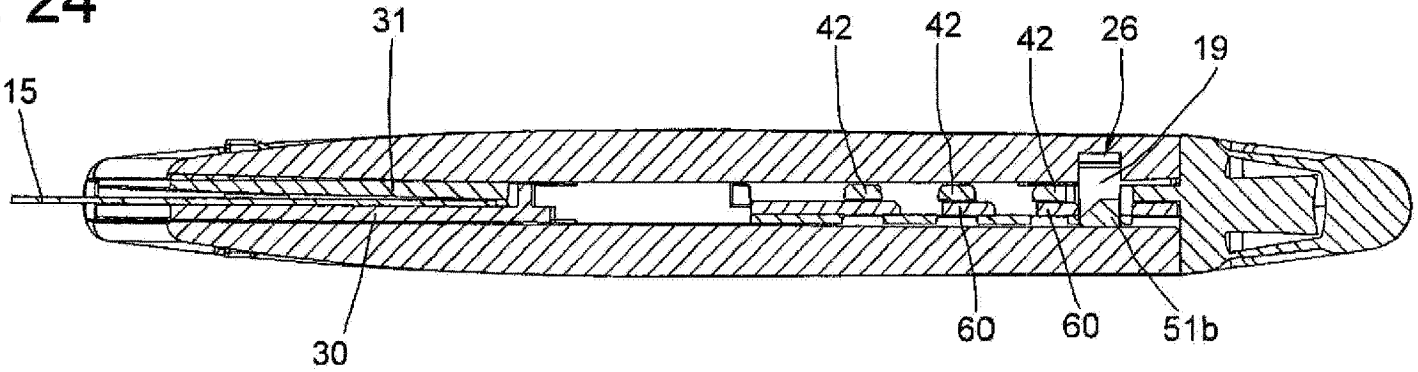
FIG. 24 is a section taken along line XXIV-XXIV of FIG. 23.

Due to the inclined surface 58, movement in the direction x2 catches the projection 43 into the cut-out 44, however, movement in the direction x1 out of the catch cut-out is not possible due to the stop surface 59. After attachment of the cover 33 to the rear part 32, according to FIG. 24 the tongues 60 of the cover 33 are engaged under the lugs 43 of the rear part 32 so that neither movement in the direction x1, x2 nor movement in the direction y1, y2 is possible. When the cover 33 is attached to the rear part 32, the blade support 20 is fixed to the second part 13 formed by the rear part 32 and the cover 33. The blade support 20 is moveable relative to the second part 13 between the rear position and a frontmost position defined by contact of the outer surface 40 with the stop surface 41.

Figure 16:
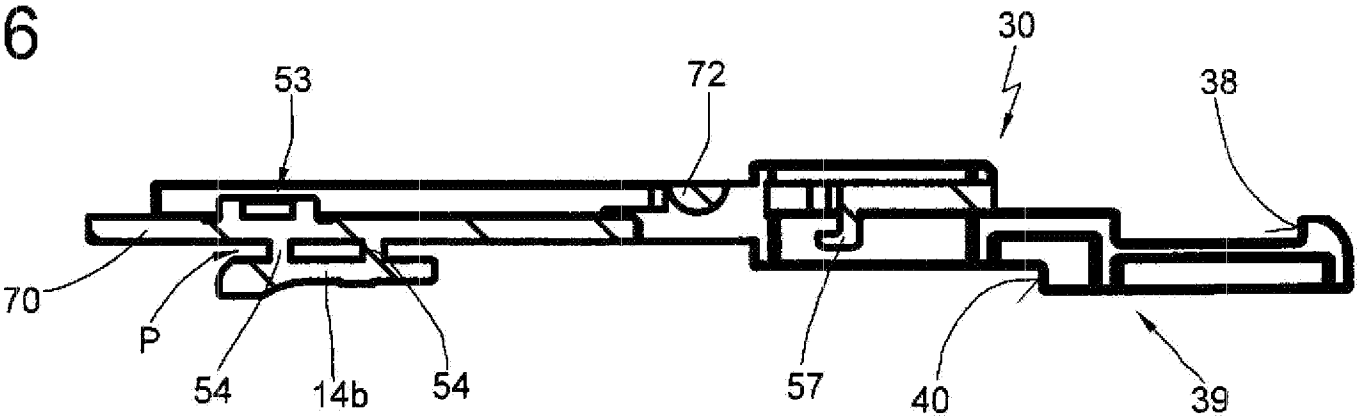
FIG. 16 is section taken along line XVI-XVI of FIG. 15.

According to FIG. 2, the blade support 20 has the rear part 30 and the latch 31. A convex cylindrical structure 72 semicircular in cross section according to FIG. 16 is part of a pivot G supporting the latch 31 on the rear part 32. The latch 31 is provided with an end region 84 that is also is part of the pivot G and that is formed with a semicylindrical cut-out 85 complementary to the structure 72.

Figure 15:
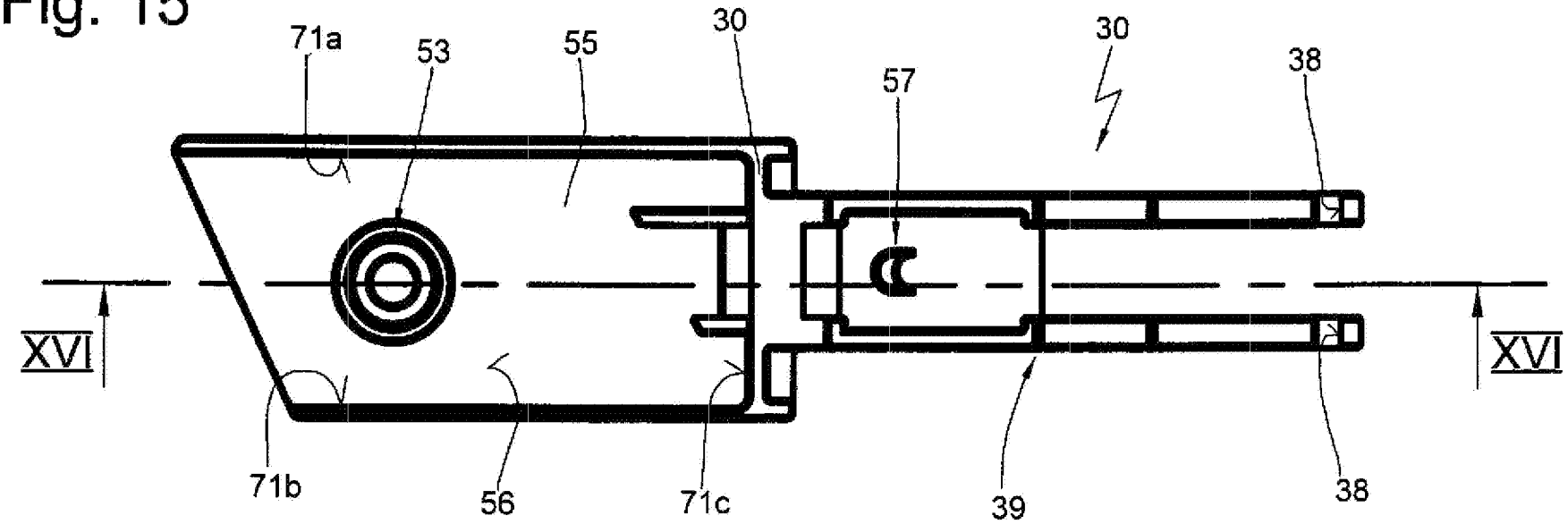
FIG. 15 is a side view of the blade support with a latch of the blade support not shown.

The handle 14*a* is attached to the latch 31, the handle 14*b* is attached to the rear part 30. FIG. 2 shows that the handle 14*b* is spaced by webs 54 from a housing wall 70 forming the blade seat 55. In the same manner the handle 14*a* is also spaced by webs 54 from the outer surface 82. According to FIGS. 15 and 16, the rear part 30 has the blade seat 55 with a blade-mounting surface 56. Furthermore, a journal 53 provided on the blade-mounting surface 56 fits with a cut-out of the blade 15 in order to positively center the blade 15. The journal 53 engages in a complementary cut-out 81 (not shown in FIGS. 15 and 16) of the latch 31. In the blade seat 55 the blade 15 is partially surrounded by inner surfaces 71*a*, 71*b* and 71*c*.

An extension 39 of the rear part 30 has an attachment element 57 to which the spring element 75 only shown in FIG. 2 can be attached. With another end region the spring element 75 can be attached to the second part 13. A stop surface 38 of the extension 39 serves to stop the blade support 20 in the base position in which the blade 15 is located in the housing 11.

The actuating element 19 of the locking device has a holding arm 51*a* and on an opposite side two further holding arms 51*b* and 51*c*. Furthermore, locking arms 50*a* and 50*b* are attached on two opposite sides. In a central region a guide journal 73 is attached, which is cylindrical. The end journal 73 is used to guide and center the spring element 74 (indicated merely as a dashed line) so as to urge the actuating element 19 in the direction y2 in the unactuated position according to FIGS. 7 and 8. In the unactuated position, holding surfaces 52 of the holding arms 51*a*, 51*b* and 51*c* bear against mating surfaces of the second part 13.

The first part 12 can be mounted on the second part 13, in that the rails 47 and 48 are pushed relative to the first part 12 into the grooves 27 and 28 in the direction x1 until a stop shoulder 37 strikes the end face 76 of the first part 12. The locking arms 50*a* and 50*b* of the actuating element 19 engage in this position into the cut-outs 26*a* and 26*b* of the first part 12 and thus lock the first part 12 on the second part 13. The second part 13 can be released from the second part 12 only when actuating element 19 is moved into the actuated position so that the locking arms 50*a* and 50*b* are moved out of the cut-outs 26*a* and 26*b*.

If the blade support 20 is located in the rear position and the actuating element 19 is moved into the actuated position, the locking arms 50*a* and 50*b* move in the travel path of the stop surfaces 38. For this reason the blade support 20 with actuating element 19 moved into the actuated position cannot move out of the rear position into the front position. This ensures better handling ability during assembly and disassembly of the first part and the second part and moreover increases safety, since accidental movement of the blade support 20 relative to the second part 13 is prevented.

The invention claimed is:

1. A knife comprising:

a longitudinally elongated housing having a first part and a second part fittable with the first part, the first part being releaseable and wholly separable from the second part for blade replacement;

a blade support formed with a stop, adapted to hold a blade, and movable relative to the second part between a retracted base position and a cutting position shifted longitudinally forwardly from the base position, the blade, when the housing parts are fitted together, projecting from the housing in the cutting position and being completely retracted into the housing in the base position;

a spring connected between the blade support and the second part and urging the blade support into the base position; and a first locking formation on the first part and a second locking formation on the second part, the first and second locking formations being displaceable relative to one another between a locking position securing the first part against movement on the second part and a release position permitting separation of the first and second parts from each other, the second locking formation releasably fixing the blade support in the base position by engaging the stop of the blade support in the release position of the first and second locking formations.

2. The knife according to claim 1, further comprising:

respective handles for actuation of the blade support attached on opposite sides of the blade support.

3. The knife according to claim 1, wherein the blade support is fixed to the second part.

4. The knife according to claim 1, wherein the first part has primary bearing and guide structures fitting positively with secondary bearing and guide structures of the second part.

5. The knife according to claim 1, wherein one of the first and second parts is provided with grooves that fit with rails of the other of the first and second parts.

6. The knife according to claim 5, wherein the grooves and the rails extend parallel to a longitudinal center axis of the knife.

7. The knife according to claim 5, wherein the grooves are of T-section and the rails are complementarily T-shaped.

8. The knife according to claim 1, further comprising:

a key button that can move the first locking formation between the locking position retaining the first and second parts together against relative movement and the release position allowing separation of the first and second parts.

9. A knife comprising:

a longitudinally elongated housing having a first part and a second part fittable with the first part, the first part being releaseable and wholly separable from the second part for blade replacement;

a blade support on the second part, formed with a stop, adapted to hold a blade, and movable relative to the second part between a retracted base position and a cutting position shifted longitudinally forwardly from the base position, the blade, when the housing parts are fitted together, projecting from the housing in the cutting position and being wholly retracted into the housing in the base position;

a spring connected between the blade support and the second part and urging the blade support into the base position; and a first locking formation on the first part and a second locking formation on the second part, the first and second locking formations being displaceable relative to one another between a locking position securing the first part against movement on the second part and a release position permitting separation of the first and second parts from each other, the second locking formation releasably fixing the blade support relative to the second part in the base position by engaging the stop of the blade support in the release position of the first and second locking formation.

10. A knife comprising:

a longitudinally elongated housing having a first part and a second part fittable with the first part, the first part being releaseable and wholly separable from the second part for blade replacement;

a blade support on the second part, formed with a stop, adapted to hold a blade, and movable relative to the second part between a retracted base position and a cutting position shifted longitudinally forwardly from the base position, the blade, when the housing parts are fitted together, projecting from the housing in the cutting position and being wholly retracted into the housing in the base position;

a spring connected between the blade support and the second part and urging the blade support into the base position; and a first locking formation on the first part and a second locking formation having an arm and on the second part, the first and second locking formations being displaceable relative to one another between a locking position securing the first part against movement on the second part and a release position permitting separation of the first and second parts from each other, the arm releasably fixing the blade support relative to the second part in the base position by engaging the stop of the blade support in the release position of the first and second locking formations.

* * * * *